United States Patent [19]

Seely

[11] 4,310,991

[45] Jan. 19, 1982

[54] DOOR SEALING SYSTEM

[75] Inventor: James R. Seely, Rochester, Mich.

[73] Assignee: Embossed Door Corporation, Detroit, Mich.

[21] Appl. No.: 79,022

[22] Filed: Sep. 26, 1979

[51] Int. Cl.[3] ..... E06B 1/70

[52] U.S. Cl. ..... 49/470; 49/471; 49/495

[58] Field of Search ..... 49/471, 470, 469, 468, 49/467, 380, 484, 495

[56] References Cited

U.S. PATENT DOCUMENTS

| | | | |
|---|---|---|---|
| 2,010,609 | 8/1935 | Shogren | 49/471 X |
| 2,129,381 | 9/1938 | Oftedal et al. | 49/471 |
| 2,592,861 | 4/1952 | Close | 49/495 X |
| 2,849,763 | 9/1958 | Leigh | 49/469 |
| 3,346,994 | 10/1967 | Kesler | 49/470 |
| 3,448,543 | 6/1969 | Multer | 49/470 |
| 3,851,420 | 12/1974 | Tibbetts | 49/470 X |
| 4,006,562 | 2/1977 | Belanger | 49/470 X |
| 4,055,917 | 11/1977 | Coller | 49/469 |
| 4,185,417 | 1/1980 | McKann | 49/470 |

*Primary Examiner*—Philip C. Kannan

*Attorney, Agent, or Firm*—Krass, Young & Schivley

[57] ABSTRACT

A sealing system for an entry door incorporates a threshold member having a longitudinally extending open-ended channel in its upper surface. The sweep utilizes a double vertical seal design which encloses the channel when the door is shut. The first seal contacts exterior portions of the channel whereas the second seal contacts interior portions of the channel. The channel is vented through the threshold so that the pressure on both sides of the first seal is equalized to minimize water seepage, while the second seal completely blocks the outside air from the interior of the building. The threshold is preferably of a two piece construction which may be snapped together to thereby minimize manufacturing and installation costs.

15 Claims, 7 Drawing Figures

DOOR SEALING SYSTEM

BACKGROUND OF THE INVENTION

This invention relates to sealing devices and, more particularly, to a sealing system for doors which block out moisture and outside air from the interior of a building.

Effectively sealing moisture and outside air from the interior of the building is an age old problem which has plagued the building industry. A variety of diverse solutions have been proposed to solve the problem. Until now, storm doors have provided the only truly effective remedy. However, storm doors are relatively expensive and require additional installation and maintenance. Furthermore, purchasers of costly decorative front doors for their homes are not overly enthusiastic about covering them up with obtrusive looking storm doors. Hence, there has been a search for a single door sealing system which provides the required weather resistance, within the confines of reasonable manufacturing expenditures. Most known prior art single door sealing systems have not responded adequately to the challenge. It is important to note that there are two distinct considerations for a single door sealing system, one being the ability to block out the outside air, and the other being the ability to seal out moisture such as rain from the interior.

One of the most common problems that have confronted builders is the proper installation of doors. This requires considerable man-hours to insure that the frames and doors are precisely in square and properly aligned. However, even if the doors are initially properly installed, settling of the house often creates a gap between the threshold and the door thereby providing a direct opening into the house. U.S. Pat. No. 3,900,967 to Bursk et al and U.S. Pat. No. 3,273,287 to Pease, Jr. are representative of prior innovations attempting to solve this problem. These patents disclose adjustable sill and threshold assemblies by which the threshold may be raised or otherwise adjusted to provide a good fit between the door and the threshold to accomodate for settling. However, these attempts only partially solve the problem because they do not provide an adequate moisture seal. Even more importantly, they require the builder to return to the premises and adjust the threshold, much to the displeasure of both the builder and the anxious homeowner.

Still other attempts have been made to correct the problem of water seeping underneath the door and into the interior. This problem is so wide spread that the American Society of Testing Materials has established as Test No. E-331 a proposed standard for moisture resistance capabilities of doors and windows. In this test, the device must be capable of completely blocking out water for a period of 15 minutes at a relative pressure differential equivalent to that created by a 30 mile per hour wind. Very few of the commercially available doors have been capable of meeting this standard and those which have been successful require painstaking and time consuming detailed workmanship to install the door.

Some of the most ambitious attempts to solve the moisture problem are disclosed in U.S. Pat. No. 3,851,420 to Tibbetts, U.S. Pat. No. 3,032,839 to Miller, U.S. Pat. No. 2,129,381 to Oftedal et al, and U.S. Pat. No. 2,108,137 to Oftedal et al. Each of these prior art systems generally employ what is known in the trade as a weep for draining the water away from the door. However, the Miller and Oftedal constructions provide a direct air leak into the home which, in this day of energy conciousness, is taboo. Likewise, the Tibbetts system is also susceptible to a gap being created at the bottom of the door when the house settles. Further, the fibrous pile material used in Tibbetts for the jamb weatherstripping does not provide adequate blockage for preventing air or water from passing around the lower sides of the door. These weep type systems are often rendered ineffective when mud or other debris clogs the drainage passages. More importantly, even moderately high winds will render the known weep systems ineffective against water seepage.

Since each of the prior art door sealing systems rely upon tight interference fits between the bottom of the doors and the threshold, relatively high forces are required to open and close the door. Obviously, this can be a problem for children, the aged or the handicapped because they often lack the strength to operate the door. Similarly, because of the high opening and closing forces commonly needed, these door seals tend to wear out or tear, thus necessitating frequent replacement.

SUMMARY OF THE INVENTION

The present invention provides all of the sealing advantages of a storm door, yet can be used as a single door sealing system without the disadvantages inherent with the use of storm doors. The present invention is based upon the discovery that the sweep and the threshold can be constructed so that they interact when the door is closed to provide a substantially enclosed channel whose pressure is equalized with the ambient air. In such manner, the interface of the sweep directly in contact with the exterior has equal pressure on both sides thereby minimizing the tendency of the water from being pulled under the sweep seal. The isolated portion of the sweep contacts the threshold interiorly of the interfacing sweep seal portion to prevent any direct leakage of the ambient air into the interior.

In the preferred embodiment, the sealing system takes the form of a threshold which has an elongated longitudinal extending open-ended channel. The sweep includes two vertical depending spaced sealing means attached to the bottom of the door. When the door is shut, the first sealing means contacts an exterior wall of the channel and the second sealing means contacts an interior wall of the channel to form a substantially closed passageway. Venting means in the threshold communicates with the channel to permit pressure equalization.

According to a feature of this invention the sweep of the present invention incorporates two spaced vertically depending resilient plates which extend the width of the door and press against the walls of the channel substantially across its entire length. The depth of the sealing plates are such that they extend down below the top portions of the channel walls to such a degree that the sealing action is not adversely effected by the door being out of square, settling or other construction errors. Since the sealing system of the present invention does not depend upon the horizontal interference fits between the sweep and the threshold, considerably less effort is required to operate the door and the seals maintain their useful life much longer than other known systems.

BRIEF DESCRIPTION OF THE DRAWINGS

These and other advantages of the invention will become apparent upon reading the following specification and reference to the drawings in which.

DETAILED DESCRIPTION OF THE PREFERRED EMBODIMENT

Figure 1:
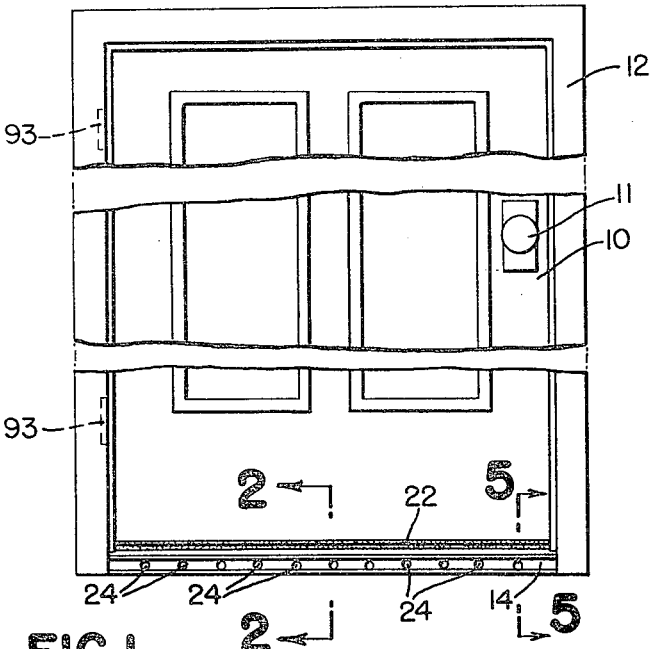
FIG. 1 is a front plan view of a door incorporating the preferred embodiment of this invention.
Figure 2:
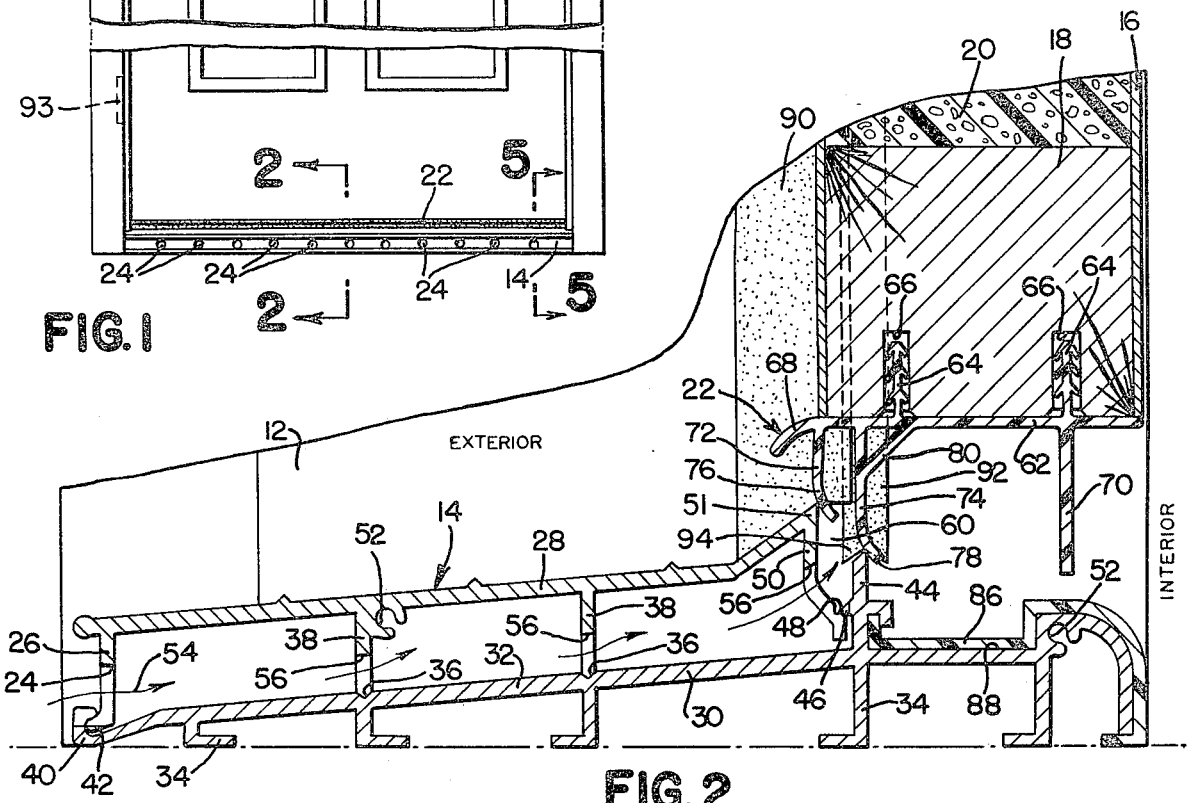
FIG. 2 is a cross-sectional view along the lines 2—2 of FIG. 1 with the door shut.
Figure 4:
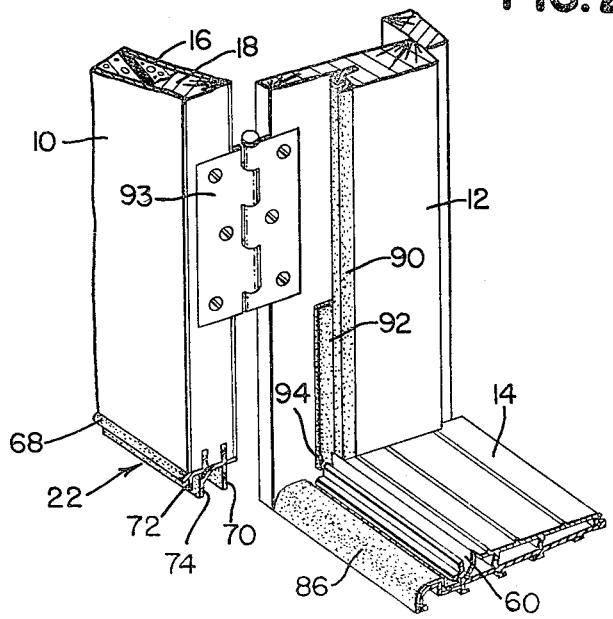
FIG. 4 is a partial perspective view of the preferred embodiment of this invention with the door shown open.

The preferred embodiment of this invention is shown in FIG. 1 in use with a conventional door 10 with a latch 11 hung within a frame or jamb 12 operative to close over a threshold 14. The type and construction of door 10 and jamb 12 can be any of a variety known in the art. In the preferred embodiment and as best shown in FIGS. 2 and 4, door 10 is a single insulated steel door having a metal shell 16, a wooden peripheral frame 18, with the interior portions being filled with an insulating material 20 such as foam. The present invention is particularly concerned with the threshold 14 and the weather seal sweep system generally designated by the numeral 22 which depends from the bottom portion of door 10.

The threshold 14 includes a plurality of openings 24 based on about 3" centers in the nose portion 26. In this embodiment, the openings 24 are approximately $\frac{3}{8}$" in diameter. As is best shown in FIG. 2, the threshold 14 is of a two piece construction having an upper member 28 and a lower member 30 formed of extruded aluminum. The lower member 30 includes an inclined ramp 32 which is supported by a plurality of vertically depending L-shaped legs 34 which increase in height from nose piece 26. Ramp 32 includes V-shaped grooves 36 which extend throughout the longitudinal length of threshold 14 and provide mating surfaces for the tapered ends of fins 38 depending from upper member 28. Lower member 30 includes a lip 40 disposed towards the nose piece 26 end which engages an ear 42 in the upper member 28. At the other end of lower member 30 there is provided a vertically extending interior wall 44 which extends the entire length of threshold 14. Interior wall 44 includes a projection 46 which engages a notch 48 in a generally vertically extending exterior wall 50 of upper member 28. Exterior wall 50 is similar to fins 38 except that its upper portion forms a ridge which extends upwardly beyond the normal extension of the flat surface of member 28 to thereby serve as door stop 51 and its lower portion is angled with respect to the vertical so as to space the remaining portions from wall 44. For purposes of this invention and for ease of description, the terms exterior and interior shall refer to their relationship with the exterior environment and the interior portions of the building for which door 10 is utilized. Exterior wall 50 similarly extends the entire longitudinal length of upper member 28. In fact, unless specifically or obviously excluded, all of the elements shown in FIG. 2 extend the entire longitudinal length of door 10 or threshold 14 as shown in FIG. 1. Screw holes 52 are provided in threshold 14 for conveniently attaching the threshold 14 to the jamb 12. The two piece construction of threshold 14 according to the teachings of this invention provides a readily manufactured device which is especially adapted for the somewhat intricate details of the interior portion of threshold 14. To assemble the threshold 14, one merely has to snap the upper member 28 and lower member 30 together so that the above-described mating surfaces are clinched together.

Special emphasis shall now be drawn to the venting passageway which is designated by the arrows 54. A plurality of such passageways 54 are formed by generally semicircular concentric openings 56 in fins 38 and exterior wall 50 of threshold upper member 28. It should be noted that the interior wall 44 and exterior wall 50 define an upwardly oriented open-ended channel 60 which longitudinally extends the length of threshold 14. Passageways 54 thus provide a direct link between the ambient air and channel 60. The number of passageways 54 and the size of their openings is chosen to insure that the atmospheric pressure in channel 60 is the same as that of the ambient air when the door is shut, the purposes for which will later be described.

Figure 3:
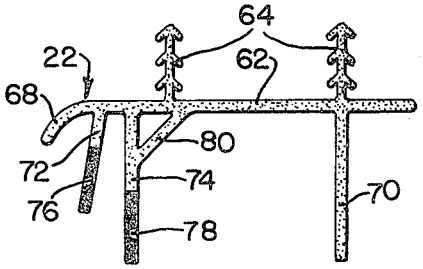
FIG. 3 is a cross-sectional view of the sweep shown in FIG. 2 showing its configuration when the door is open.

Turn now to the specifics of the sweep 22, with special emphasis being drawn to FIGS. 2 and 3 which show the configuration of sweep 22 when the door is closed and opened, respectively. It should be understood that sweep 22, while shown in cross section in these drawings, actually extends across the entire width of door 10. Sweep 22 includes a generally horizontally disposed base member 62 having two rows of upwardly extending protuberances, known in the art as Christmas trees 64 for engaging slots 66 in the bottom portion of door 10. Trees 64 generally include an upwardly extending trunk and a plurality of resilient branches which provide an interference fit with slots 66. The exteriorly disposed lateral edge of base 62 includes a drip cap 68 which curls downwardly toward threshold 14. Plate 70 downwardly depends from base 62 opposite from tree 64 and serves to aesthetically enclose the system when the door is shut.

Special attention is drawn to the two spaced downward projections of sweep 22 disposed close to the exterior. Interface seal 72 and primary air seal 74 are each resilient plate-like structures which generally vertically depend from base 62. In the unstressed condition as shown in FIG. 3, interface seal 72 is oriented at about 7° from the vertical in the exterior direction to increase the contact force with the threshold. The end portions 76, 78 of seals 72, 74 respectively, are formed of a material which is more resilient than the remainder of sweep 22. Branches on trees 74, however, can also be made of the same resiliency as tips 76 and 78. In the preferred embodiment, the sweep 22 is formed of dual durometer vinyl, a material which is well known in the art. Sweep 22 also includes a cross member 80 bridging base 62 and seal 74 for providing additional rigidity, but this is not critical.

Seals 72 and 74 extend the entire width of door 10 and provide a dual vertical sealing system. When the door is shut as shown in FIG. 2, end portion 76 of interface seal 72 contacts the interior portion of the exterior wall 50 of channel 60 in theshold 14. Similarly, end portion 78 of primary air seal 74 contacts the interior portion of the interior channel wall 44. Thus, when the door is closed, the channel 60 is enclosed throughout its entire length. However, passageways 54 communicating with channel 60 serve to equalize the pressure on either side of interface seal 72. The primary air seal 74 serves to prevent any of the pressure equalizing air from entering into the interior.

This dual vertical sweep sealing system provides substantial advantages over the prior art. By equalizing the pressure on both sides of interface seal 72, the tendency of any water to be sucked into the interior, which is generally at a lower pressure, is substantially eliminated. If any water does by chance seep through interface seal 72, it will be collected in the bottom portions of channel 60 and drained through passageways 54 and out the nose piece 26. While primary air seal 74 is not at pressure equilibrium, the moisture, if any, is prevented from splashing onto the seal 74-wall 44 interface by the interface seal 72 which effectively acts as a splash guard. As noted above, primary air seal 74 prevents any of the pressure equalizing air from entering into the house.

The unique sealing system of the present invention has met the aforementioned American Society of Testing Materials standards as set forth in Test No. E-331. In fact, it has substantially exceeded these test requirements in that it has prevented any water leakage for several hours at pressure differentials equivalent to 50 mile per hour winds. This is to be compared to the standard of 15 minutes worth of blockage at only a 30 MPH equivalent pressure which, as noted herein, has heretofore been extremely hard to meet.

The design of the present invention has further advantages not found in any of the known systems. One of the primary advantages is that the dual vertical wiper plates which make up seals 72, 74 of sweep 22 automatically compensate for frames and doors which are slightly out of square. The length of the seals 72 and 74 are chosen to extend beyond the top portions of their respective channel walls. As a specific example, which is not to be construed as limiting, the length of seal 74 is about 0.75" whereas the length of seal 72 is about 0.55". The resilient end portions 76 and 78 are each about 0.25" in length. Preferably, the seals 72 and 74 extend at least about ⅛" beyond the top of their respective channel walls. Thus, it can be seen that the door 10 can be slightly skewed with respect to the threshold 14 and yet there will be a complete seal along the entire width of the door even if there is an ⅛" differential therebetween. Of course, the length of the seals can be varied depending upon the specific application.

Another advantage of the present invention is that less force is required to open and close the door since the sealing arrangement is performed by overlapping pressing engagement as compared with the interference fitting weatherstripping used previously. In FIG. 2 it can be seen that the exterior channel wall 50 extends upwardly beyond the top portion of interior channel wall 44. Interface seal 72 is slightly shorter than primary air seal 74. Thus, when the door is shut interface seal 72 passes over channel wall 44 until it abuts exterior wall 50 which serves as stop 51.

Still another advantage of the present invention is that the seals will exhibit a much longer useful life since they are not subject to the relatively high frictional forces that are common to known weatherstripping arrangements which are dragged over the threshold thereby developing high frictional forces and interference fits to effect the sealing action.

In typical use of the present invention, the threshold 14 may be fitted with a thermally insulating cover 86 which snaps onto a trough portion 88 of lower threshold member 30 on the interior side of channel wall 44. The vertical portions of the jamb 12 may include weatherstripping 90 which is fitted in a tongue and grooved fashion to span the vertical length of each side of the door. A side seal 92, preferably made of an adhesive backed sponge rubber material, is applied to lower portions of each side of the jamb 12 to seal off the extreme ends of the threshold channel 60. Threshold 14 can then be snapped together and screwed into the lower side portions of the jamb 12. Door 10 is then fitted with sweep 22 by pushing trees 64 into slots 66. The door 10 can then be mounted onto jamb 12 as by hinges 93. Of course, the door 10 can be prehung on frame 12 at the factory and such is envisioned as probably the most practical method. However, the assembly can be built up part by part on the building site and/or existing doors can be retrofitted with the unique threshold and sweep as taught by this invention.

Figure 5:
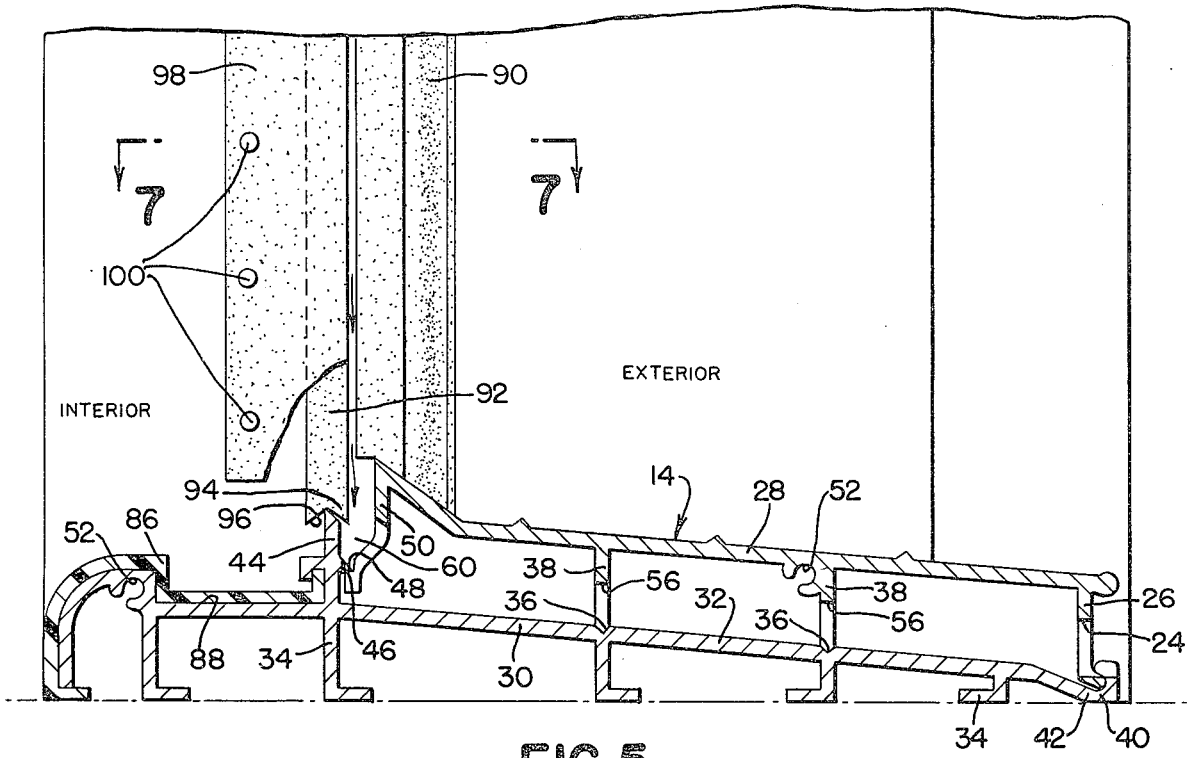
FIG. 5 is a cross-sectional view along the lines 5—5 of FIG. 1 with the door open.

To further insure the sealing action of the system, the side seals 92 are formed with an overhang portion 94 whose tip is sufficiently spaced from the interior wall 44-primary air seal 74 interface that water which may seep underneath vertical weatherstripping 90 is diverted away from this area and into bottom portions of channel 60 where it is drained away. As can be seen most clearly in FIG. 5, overhang portion 94 is preferably formed by providing an inverted V-shaped notch in the bottom of side seal 92. The V-shape aids in registering the seal 92 with threshold 14 since the top of interor wall 44 may conveniently be nested in the apex of the V-shaped notch 96.

Figure 6:
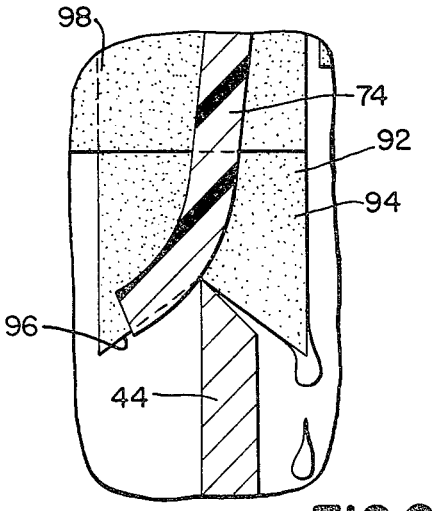
FIG. 6 is an enlarged view of end portions of the preferred embodiment.

It has been determined through experimentation that the commonly used vertical weatherstripping, such as the magnetic bellows weatherstripping shown in the latch side of jamb 12 may permit water seepage under high wind conditions. The pressure differential would cause droplets of water to be built up between the vertical weatherstripping 90 and the side seal 92 as shown diagrammatically by the arrows in FIG. 5. When a sufficient size of droplet is built up, it falls downwardly. Accordingly to a feature of this invention, the unique side seal 92 configuration permits the use of these known weatherstripping arrangements without deleterious effects. As can be seen in FIG. 6, the water droplets are diverted away from seal 74-wall 44 interface by overhang 94 and allowed to fall downwardly into channel 60 where it is drained away by passageways 54. In addition to the autoregistration advantage, the V-shape of the notch 96 provides an inclined surface for overhang 94 which inhibits the water from reaching the seal 74-wall 44 interface. Preferably, the inclined angle of notch 96 is greater than the angle defined by the top portion of wall 44, and in this embodiment is about 75°–100°.

Figure 7:
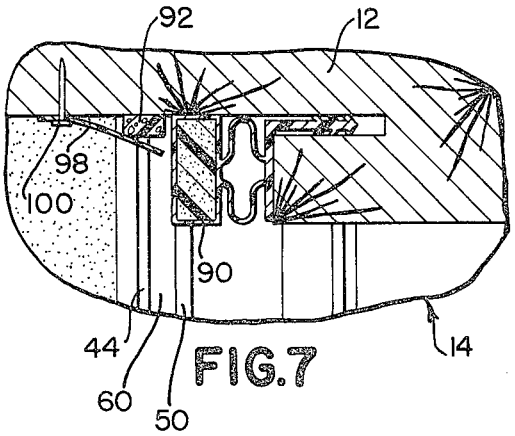
FIG. 7 is a top plan view along the lines 7—7 of FIG. 5.

Still another feature of this invention is the use of flexible shield 98 which overlies side seal 92 on the door latch side of the jamb 12. Shield 98 is affixed on its interior side to jamb 12 via nails 100. Shield 100 thus provides a ramp (see FIG. 7) for guiding the latch side of the door into pressure contact with the major surface of side seal 92. Shield 100 prolongs the life of the sponge rubber side seal 92 which provides better sealing qualities than pile material which is normally utilized for side seals on the latch side of the door.

From the foregoing description, one skilled in the art can readily appreciate that the present invention provides a unique conceptual solution to the long standing problems of moisture and air sealing systems of the prior art. While the preferred embodiment has unique advantages, it should not be construed as limiting, and one attempting to use this invention should realize that other modifications will become apparent to one skilled in the art and yet fall within the spirit of this invention.

The embodiments of the invention in which an exclusive property or privilege is claimed are defined as follows:

1. A sealing system for an inwardly swinging door comprising:

a threshold member having an elongated open-ended channel defined by an exterior wall having a vertically extending portion of a given height serving as a door stop and an inclined lower portion meeting a spaced vertically extending interior wall of lesser height;

a first resilient sealing plate vertically depending from bottom portions of the door and having a given length, operative to overlappingly contact the interior channel wall to provide a primary air seal between the exterior and the interior;

a second resilient sealing plate vertically depending from bottom portions of the door for overlappingly contacting the exterior channel wall, said second sealing plate having a shorter length than said first sealing plate, the extent of the projections of said walls and plates being such that the plates come into contact with their respective walls free from interference with other portions of the threshold, and such that the vertical overlap between the plates and walls provides continuous contact therebetween to automatically accomodate for misalignment between the door and threshold; and venting means in the threshold member including passageways from frontal portions thereof through said lower portion of the exterior channel wall, adapted for equalizing the pressure differential between the channel and the exterior air to thereby minimize seepage of moisture under the second seal while the first seal blocks the air from entering the interior.

2. The system of claim 1 wherein said threshold comprises:

a top portion having a major surface and a plurality of fins depending therefrom;

a lower portion having a major surface inclined to the horizontal; and means for detachably fastening said upper and lower portions together.

3. The system of claim 2 wherein the fins of the upper threshold member portion include semicircular openings therein which are closed by the major surface of the lower threshold member portion to thereby form a passageway within the interior portions of the threshold member for venting said channel.

4. The system of claim 1 wherein said first and second sealing means are integral parts of a sweep comprising:

a base member adapted to be fitted flush against the entire bottom portion of the door, said base member including a curled lateral end projecting from the front of the door to form a drip cap for the sweep; and means for attaching the base member to the bottom portion of the door.

5. The system of claim 4 wherein said means for attaching comprises at least one strip projecting from said sweep base opposite from said sealing plates and having resilient means thereon for engaging a slot in the bottom of the door.

6. The system of claim 1 wherein said threshold member further includes a trough disposed interiorly of said channel, thermal insulating means covering said trough, and a back plate depending from the bottom of the door for substantially enclosing said trough when the door is shut.

7. In an apparatus for weather sealing a door unit, said unit including a door, a frame, and a threshold; wherein the improvement comprises:

means defining a longitudinally extending open-ended channel in an upper surface of the threshold, said channel having a vertically extending interior wall, a spaced vertically extending exterior wall, and a bottom portion;

sweep means attached to the bottom of the door and including at least one downwardly projecting resilient sealing plate for contacting the interior channel wall; and side sealing means attached to the frame and disposed near the ends of said threshold, said side sealing means including an inverted V-shaped notch in lower portions thereof into which said interior channel wall is nested, adapted for diverting water away from the sealing plate and channel wall interface when the door is shut to thereby prevent water from seeping under the sealing plate and into the interior.

8. The improvement of claim 7 wherein said side sealing means is formed of sponge rubber.

9. The improvement of claim 8 which further comprises: a shield affixed to the frame on the latch side of the door for guiding the door into pressure contact with said side sealing means.

10. The improvement of claim 9 wherein said shield is a resilient plastic strip overlying said side sealing means and affixed along its interior edge to the frame.

11. The improvement of claim 10 wherein said sweep means further includes another spaced downwardly projecting resilient plate which cooperates with the one plate to enclose the channel when the door is shut.

12. The improvement of claim 11 which further comprises:

venting means in the threshold and communicating with the channel for equalizing the pressure on both sides of said other plate while the one plate blocks exterior air from the interior.

13. In an apparatus for sealing the latch side of a door unit, with said unit including a door, a frame, a threshold, and a sealing device on the bottom portion of the door for contacting the threshold, wherein the improvement comprises:

a resilient rubber side seal affixed to the latch side of the frame mediate the ends of the threshold;

means on the side seal for diverting water away from the sealing device-threshold interface when the door is shut; and a shield covering said side seal and being affixed along one edge to the frame thereby providing a ramp for guiding the door into pressure contact with the rubber side seal.

14. The improvement of claim 13 wherein said shield is made of flexible plastic; and the side seal is sponge rubber.

15. The improvement of claim 13 wherein said side seal includes an inverted V-shaped notch on lower portions thereof and providing an overhang for diverting the water from the sealing device-threshold interface.

* * * * *